United States Patent [19]

Braun et al.

[11] Patent Number: 4,964,288

[45] Date of Patent: Oct. 23, 1990

[54] LOCKING DEVICE AND REVERSIBLE KEY

[75] Inventors: Peter B. Braun, Bornheim; Herbert P. Häuser, Elsdorf-Heppendorf; Alexander Stefanescu, Cologne, all of Fed. Rep. of Germany

[73] Assignee: DOM-Sicherheitstechnik GmbH & Co. KG, Cologne, Fed. Rep. of Germany

[21] Appl. No.: 387,045

[22] Filed: Jul. 31, 1989

[30] Foreign Application Priority Data

Aug. 16, 1988 [DE] Fed. Rep. of Germany ..... 3827687

[51] Int. Cl.[5] ..... E05B 19/04

[52] U.S. Cl. ..... 70/406; 70/358; 70/409

[58] Field of Search ..... 70/406, 358, 405, 402, 70/407, 409

[56] References Cited

U.S. PATENT DOCUMENTS

| | | | |
|---|---|---|---|
| 3,393,542 | 7/1968 | Crepinsek . | |
| 3,412,588 | 11/1968 | Schwegler | 70/358 |
| 4,116,025 | 9/1978 | Wolter | 70/358 |
| 4,612,787 | 9/1986 | Prunbauer . | |

*Primary Examiner*—Robert L. Wolfe

*Attorney, Agent, or Firm*—Barry E. Deutsch; J. Bruce Hoofnagle

[57] ABSTRACT

A locking device comprises a lock cylinder and a reversible flat key having indentations located on opposite broad faces of the key for the arrangement of tumbler pins, and having a rib associated with each row of indentations, into the sectional area of which at least one of the pins extends and the crest of which rib projects beyond the broad face of the key. The deepest reached indentation lies nearest to the crest of the rib and several indentations of a row of indentations are integrated into a through groove of variable depth levels.

13 Claims, 4 Drawing Sheets

LOCKING DEVICE AND REVERSIBLE KEY

BACKGROUND OF THE INVENTION

The invention relates to a locking device comprising a cylinder lock and reversible flat key, having indentations located on opposite broad faces of the key for the arrangement of tumbler pins, and having a rib associated with each row of indentations, into the sectional area of which at least one of the pins extends, and the crest of which rib projects beyond the broad face of the key. A locking device of this kind is described in DE-PS No. 2 658 495, in which the locking indentations, departing from the crest of the rib, are incorporated into the reversible flat key. The ribs are projecting bulges of material, compared with the normal profile. The total thickness in the region of the ribs cannot however be used for the provision of indentations of maximum depth, since otherwise the indentations lying on the same cross-sectional plane would penetrate each other. In practice, the locking indentations are usually produced by a boring cutter having a diameter of approximately 4.5 mm, which is of course greater than that of the tumbler pins. If a boring cutter were to be used, the diameter of which was close to that of the tumbler pins, then for an indentation, the height of which is greater than that of the tumbler pin point, insertion or withdrawal of the reversible flat key could be made impossible because of the catching step formed along the length of the key.

SUMMARY OF THE INVENTION

It is an object of the present invention to develop a locking device of the kind referred to above in a technically simple way so that an increased number of gradations of normal size can be produced without noticeably weakening the key shank while maintaining ease of insertion or withdrawal of the reversible flat key.

The invention provides a locking device comprising a lock cylinder and a reversible flat key having indentations located on opposite broad faces of the key for the arrangement of tumbler pins, and having a rib associated with each row of indentations, into the sectional area of which at least one of the pins extends and the crest of which rib projects beyond the broad face of the key, characterised in that the deepest reaching indentation lies nearest to the crest of the rib and that several indentations of a row of indentations are integrated into a through groove of variable depth levels.

The invention also provides a reversible flat key having indentations located on opposite broad faces of the key for the arrangement of tumbler pins in a corresponding lock cylinder, and having a rib associated with each row of indentations, into the sectional area of which at least one of the pins is adapted to extend, and the crest of which rib projects beyond the broad face of the key, characterised in that the deepest reaching indentation lies nearest to the crest of the rib and that several indentations of a row of indentations are integrated into a through groove of variable depth levels.

As a result of this design a locking device of the type referred to above is provided with improved security. An increased number of gradations in the rib region is now possible, since the locking indentations depart from the broad face of the key opposite to the ribs in such a manner, that the deepest indentation lies nearest to the crest of the rib. By integrating several indentations of a row of indentations into the through groove at different depth levels, it is possible for the indentations to be produced by means of a boring cutter, the diameter of which is approximately the same as that of the tumbler pins. There are however no catching steps produced, which could impede the withdrawal of the inserted key. Because of the small diameter of the boring cutter the disadvantage does not arise that for indentations of maximum depth the indentations lying on the same cross-sectional plane penetrate each other resulting in considerable weakening of the key shank. In addition, unauthorised copying of the reversible flat key is made more difficult, which also improves the security of the locking device. It has proved to increase the stability of the rib for it to be made of trapezoidal cross section. This fits with the tapered tips of the plug pins. In order that, for grooves of maximum depth, which extend to the crest of the rib, the rib still remains locked, its width near the base is greater than the width of the groove produced by the boring cutter. Easy sliding of the key within the keyway is obtained since the depth levels of the groove of adjacent indentations are joined together by groove faces running in straight lines. In order to get from one depth level to the other, the tips of the plug pins do not need to be moved back up to the appropriate broad face of the key in most cases. Also, insertion of the reversible flat key into the keyway is easy. Before the plug pins tips arrive at the row of indentations, they pass over the lead-in bevel which is arranged at the front of the key and extends in front of each row of indentations, which bevel is designed in form of a single slot. By this means the plug pins are laterally centred as soon as they come into contact with the lead-in bevel, reducing the possibility of tilting, which would impede insertion of the reversible flat key. Lateral guidance of the plug pins is thus maintained until they run off the lead-in bevel on the opposite broad face of the key. The tumbler pin bores then take over most of the guiding of the plug pins. During the reciprocating motion of the plug pins resulting from the key being pushed further into the keyway optimal guiding and centering of the plug pins is still retained because the row of indentations is formed as a through groove.

Good guiding of the reversible flat key is enhanced by the fact, that the keyway has a keyseat which matches the rib. Since the cross section of the keyseat matches the shape of the plug pin ends, the keyseat has a further function in that it forms a bridge-shaped support for the pins when the key is withdrawn. By this means the plug pins are aligned so that they are always reliably engaged by the lead-in bevel when the key is inserted, so that lateral guidance of the plug pin ends is retained over the whole insertion distance for the key.

BRIEF DESCRIPTION OF THE DRAWINGS

An exemplary embodiment of a locking device according to the invention will now be described with reference to the accompanying drawings, in which.

DETAILED DESCRIPTION OF THE PREFERRED EMBODIMENT

Figure 1:
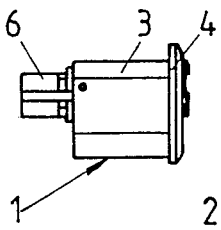
FIG. 1 is a view of the cylinder lock of the locking device.
Figure 2:
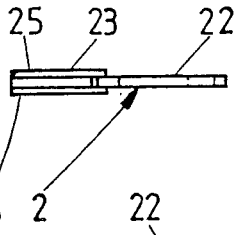
FIG. 2 shows the mating reversible flat key, corresponding to the insertion position.
Figure 3:
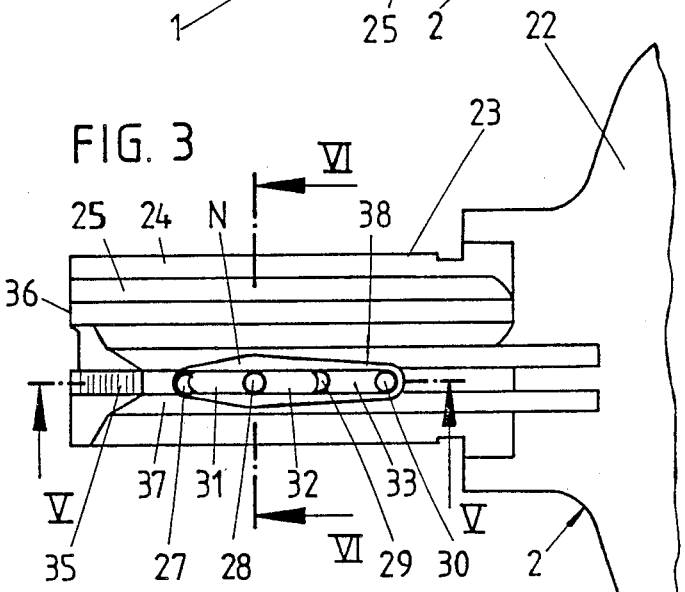
FIG. 3 shows, in greatly enlarged representation, a plan view onto the one broad side face of the reversible flat key.
Figure 4:
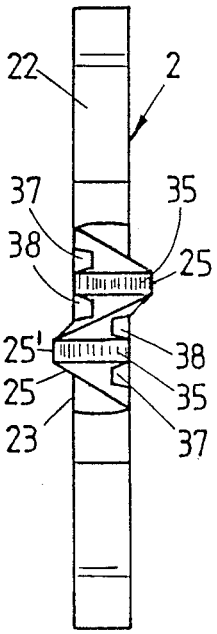
FIG. 4 shows an end view of the flat key according to FIG. 3.
Figure 5:
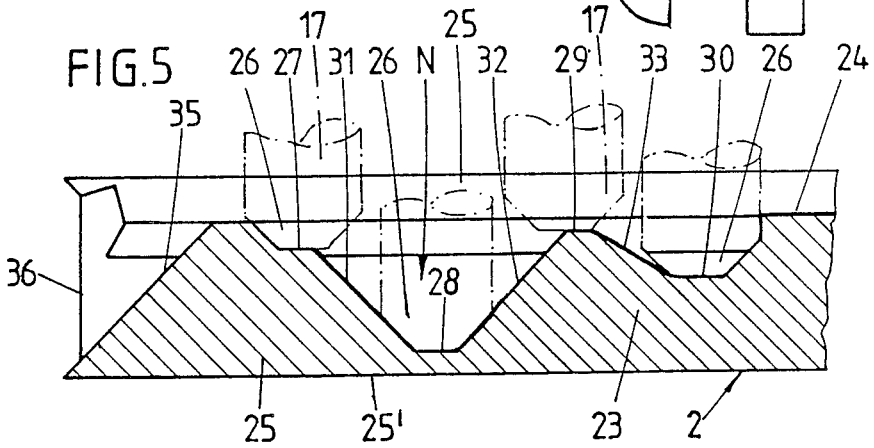
FIG. 5 shows a sectional view on the line V—V of FIG. 3.

The locking device comprises a lock cylinder 1 and a reversible flat key 2. The lock cylinder 1 has a cylinder housing 3, which is provided at its front end with a flange 4. The stepped-down section adjoining the latter is provided with a thread (not illustrated herein in further detail). In eccentric disposition relative to the cylinder housing 3, a bore 5 extends within the housing 3 to house a cylinder plug 6. The plug 6 is locked in position in the axial direction. The cylinder plug 6 is penetrated by a keyway 7 extending in longitudinal direction along the plug, the one narrow side of which extends to the cylinder plug bore 5. From the broad side walls 8, 9 of the keyway 7 depart keyseats 10 or 11 staggered relative to each other, which are of trapezoidal cross section. Then each broad side wall 8, 9 at the side of the keyseat 10, 11 is flanked by two keyway ribs 12,, 13 or 14, 15 projecting into the keyway 7.

Perpendicular to the keyway 7 the cylinder plug 6 is provided with tumbler bores 16 lying one behind the other for housing plug pins 17, the ends 18 of which are frusto-conically tapered and which project into the keyway 7, so that the plug pin ends 18 engage with matching profiles in the keyseat 10. Into this position the plug pins 17 are pushed by housing pins 19, which can be displaced in housing bores 20. The bores 20 align with the corresponding tumbler bores 16 of the cylinder plug 6 and house the compression springs 21, which exert their force through the housing pins 19 onto the core pins 17.

Figure 6:
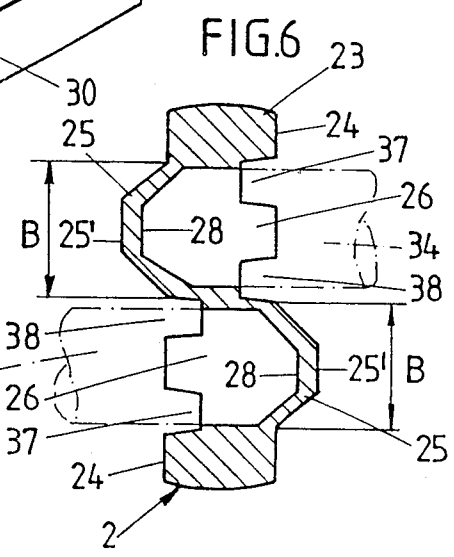
FIG. 6 shows a sectional view on the line VI—VI of FIG. 3.
Figure 7:
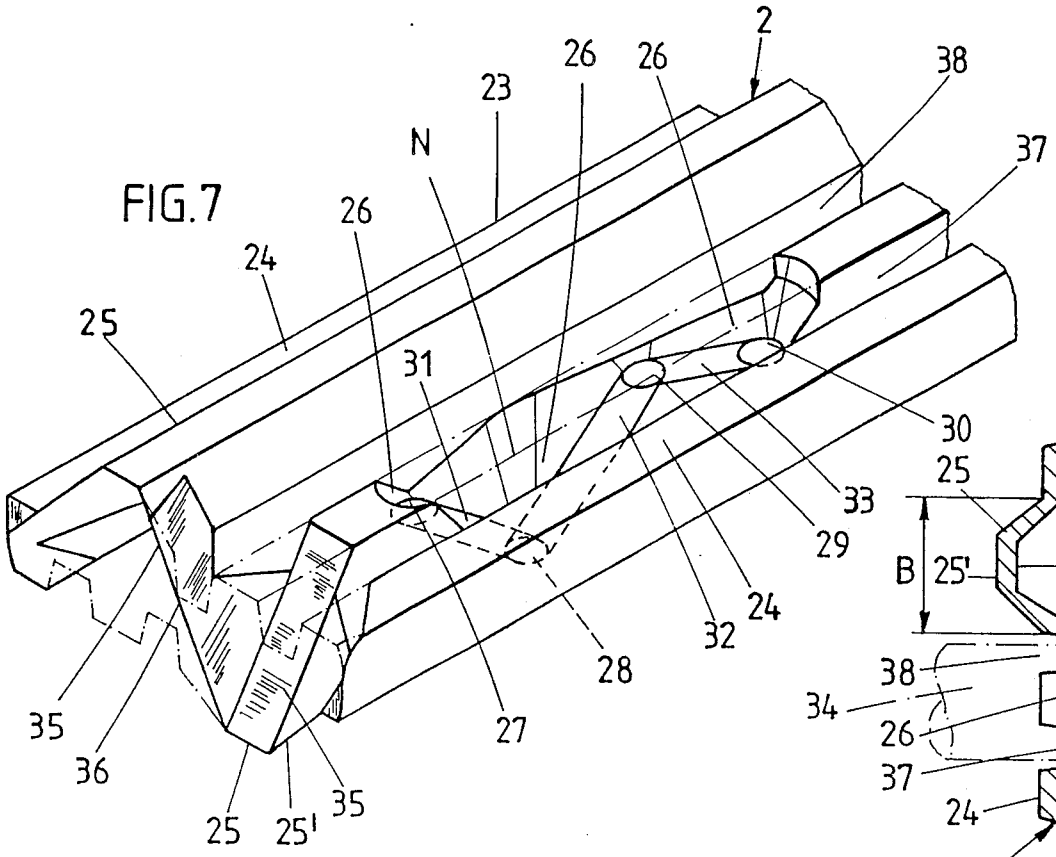
FIG. 7 shows a perspective representation of a key shank, as seen from the front of the key.
Figure 8:
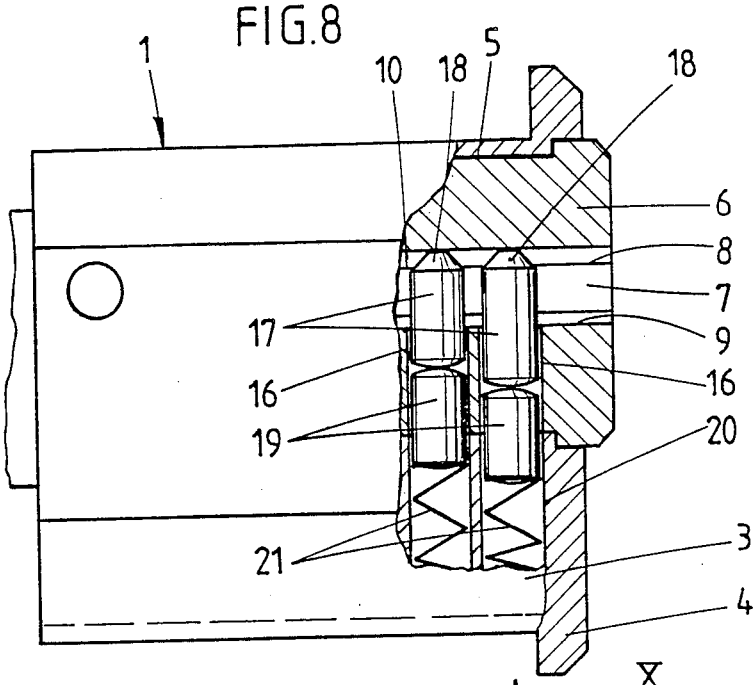
FIG. 8 shows a view of the lock cylinder, partially in longitudinal section.
Figure 9:
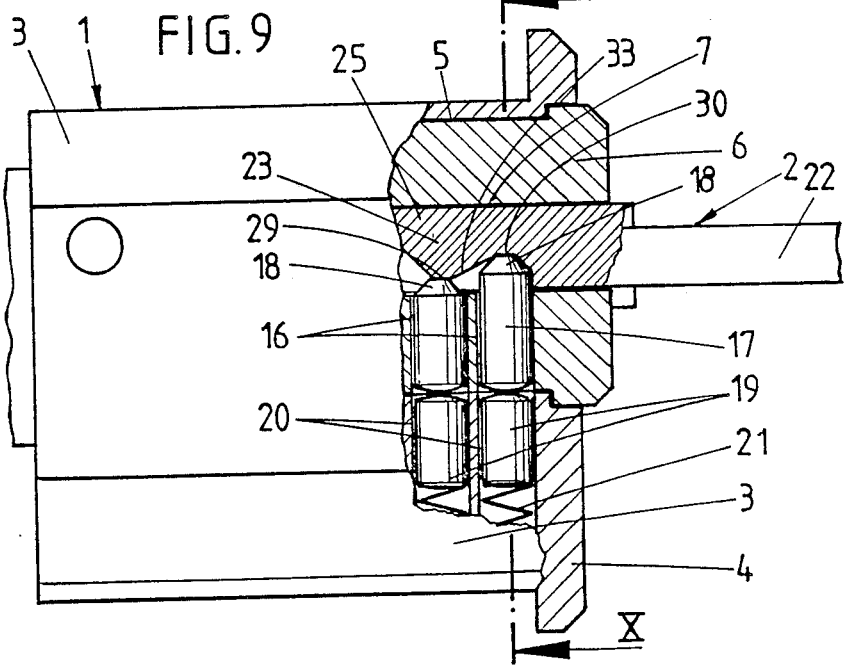
FIG. 9 shows a representation resembling FIG. 8, but with a reversible flat key inserted.
Figure 10:
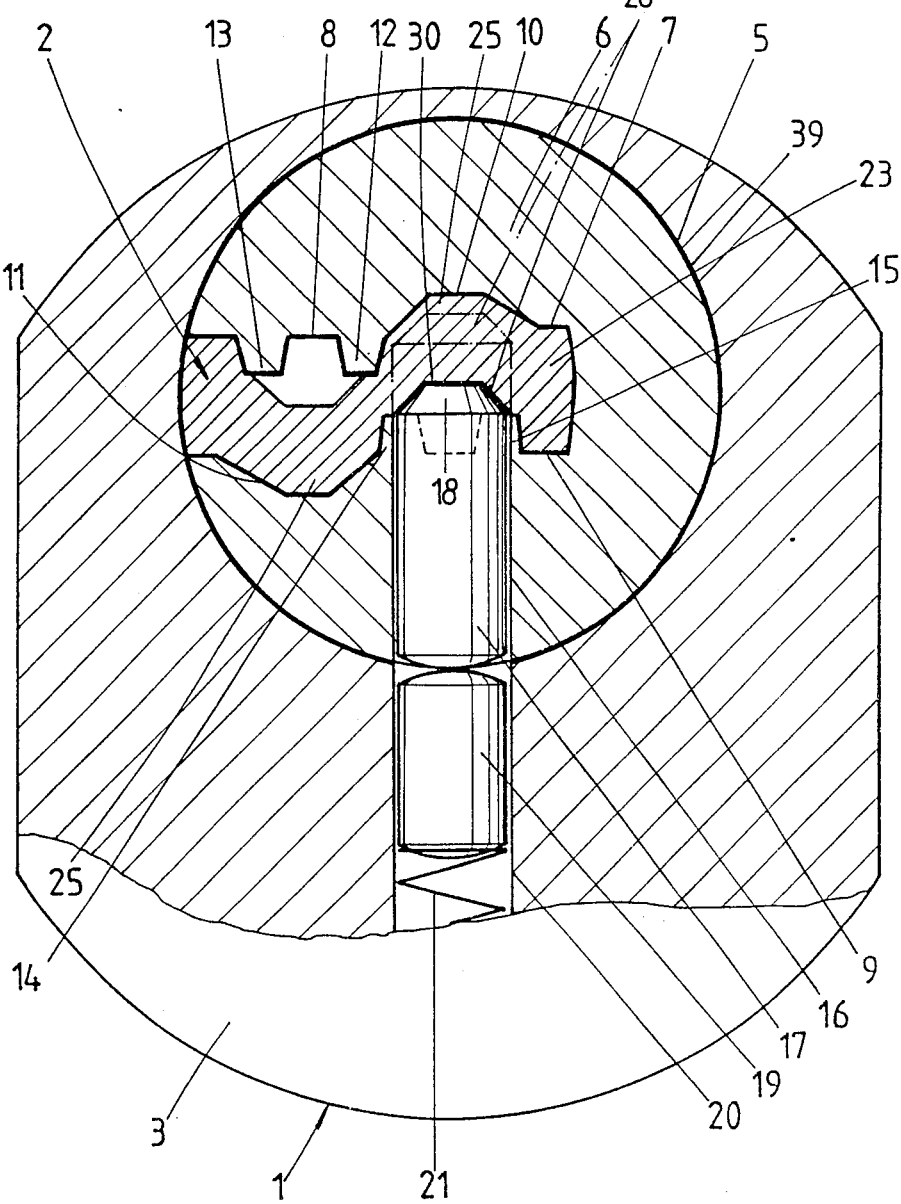
FIG. 10 shows a sectional view on the line X—X of FIG. 9.

The mating reversible flat key 2 comprises a key handle 22 and key shank 23 adjoining the handle. The cross-sectional profile of the shank matches that of the keyway 7. From each broad face 24 of the key departs a rib 25, which ribs are staggered relative to the longitudinal centre axis of the key because of the design of the key as a reversible flat key. Each rib 25 has a trapezoidal profile. Into the broad side face 24 opposite the rib 25 the indentations 26 are incorporated in such a manner, as shown in particular in FIG. 6, that the indentation 26 extending deepest lies closest to the crest 25' of the rib. The drawings illustrate further, that several indentations of a row of indentations are integrated into a through groove N of variable depth levels 27, 28, 29, 30. The depth levels of adjoining indentations are joined together here by groove faces 31, 32, 33 running in straight lines. To produce the groove N, a boring cutter 34 illustrated in FIG. 6 in dash-dotted lines, is used, the diameter of which corresponds to that of the plug pins 17. Even in the case of indentations 26 extending to the maximum depth, as can be seen in FIG. 6, there is no danger of the indentations breaking through. The key shank 23 is consequently also not significantly weakened where the indentations are incised to a maximum depth.

A lead-in bevel 35 extends at the front of each row of indentations. It is arranged at the front of the key 36 and starts at the crest 25' of the rib 25:

The lead-in bevel 35 then penetrates the key profile in a slit-like manner and thus forms a gate, through which the plug pin ends 18 pass when the key is inserted. The plug pin ends are consequently centered and guided by this gate. The corresponding lead-in bevel then ends at the opposite broad face (24) of the key.

Adjacent to each rib 25 are two further keyway slots 37, 38. These extend in the longitudinal direction of the key and are arranged so that the web remaining between the keyway slots 37, 38 is located at the level of the row of indentations.

If the lock cylinder 1 is to be locked, the reversible flat key 2 is inserted in either of its reversible positions into the keyway 7 of the cylinder plug 6. Upon insertion of the reversible flat key the tapered plug pin ends 18 run through the singular slot on the front of the key 36 formed by the lead-in bevel 35 and then arrive in the indentations 26 formed in the through groove N, so that the plug pins 17 in their front region are also guided and centered. The further the plug pins 17 move out of their tumbler bores 16, the more they are then guided by the groove N. On complete insertion of the key, the plug pin ends 18 then abut against the depth levels 27, 28, 29, 30 so that the separating plane between the plug pins 17 and the housing pins 19 lies on the shear line 39 of the cylinder plug. The cylinder plug 6 can now be turned by means of the reversible flat key 2 in order to carry out the locking operation.

We claim:

1. A locking device comprising a lock cylinder and a reversible flat key having at least one broad face on each of opposite sides of said key with a row of indentations located on each of said broad faces of said key for the arrangement of tumbler pins, and having a rib on each side of said key and associated with each row of indentations, into the sectional area of which at least one of the pins extends and the crest of which said rib projects beyond said associated broad face of the key, wherein the deepest reaching indentation of said row on one side of said key lies nearest to said crest of said rib which projects beyond said broad face on the opposite side of said key and that several indentations of said row of indentations are integrated into a through groove of variable depth levels.

2. A locking device according to claim 1, wherein said rib is of trapezoidal cross-section.

3. A locking device according to claim 1, wherein the width of said rib is greater near its base than the width of said groove.

4. A locking device according to claim 1, wherein said depth levels of said groove of adjacent indentations are joined together by groove faces running in a straight line.

5. A locking device according to claim 1, wherein a lead-in bevel is disposed at the front of said key and extends in front of each row of indentations, which bevel starts at said crest of said rib, then afterwards penetrates said profile of the key in a slit-like manner and ends at said opposite broad face of said key.

6. A locking device according to claim 1, wherein said keyway has a keyseat matching said rib, the cross-section of which keyseat matches the periphery of the plug pin ends.

7. A reversible flat key having at least one broad face on each of opposite sides of said key with a row of indentations located on each of said broad faces of the key for the arrangement of tumbler pins in a corresponding lock cylinder, and having a rib on each side of said key and associated with each row of indentations, into the sectional area of which at least one of the pins is adapted to extend, and the crest of which rib projects beyond the associated broad face of the key, wherein the deepest reaching indentation lies nearest to said crest of said rib which projects beyond said broad face on the opposite side of said key and several indentations of a row of indentations are integrated into a through groove of variable depth levels.

8. Reversible flat key according to claim 7, wherein said rib is of trapezoidal cross-section.

9. Reversible flat key according to claim 7, wherein the width of the rib is greater near its root than width of said groove.

10. Reversible flat key according to claim 7, wherein said depth levels of said groove of adjacent indentations are joined together by groove faces running in a straight line.

11. Reversible flat key according to claim 7, wherein a lead-in bevel is disposed at the front of said key and extends in front of each row of indentations, which bevel starts at the crest of the rib, then afterwards penetrates the profile of said key in a slit-like manner and ends at said opposite broad face of said key.

12. Reversible flat key according to claim 7, wherein said keyway has a keyseat matching said rib, the cross-section of which keyseat matches the periphery of the plug pin ends.

13. Key blank for use in the manufacture of a reversible flat key as claimed in claim 7.

* * * * *